US009429392B1

(12) United States Patent
Ledbetter

(10) Patent No.: US 9,429,392 B1
(45) Date of Patent: Aug. 30, 2016

(54) ARROW AIMING APPARATUS FOR BOWSTRING RELEASES

(71) Applicant: Emory David Ledbetter, Canton, GA (US)

(72) Inventor: Emory David Ledbetter, Canton, GA (US)

( * ) Notice: Subject to any disclaimer, the term of this patent is extended or adjusted under 35 U.S.C. 154(b) by 0 days.

(21) Appl. No.: 14/630,761

(22) Filed: Feb. 25, 2015

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265; 124/87
See application file for complete search history.

(56) References Cited

U.S. PATENT DOCUMENTS 2,819,707 A * 1/1958 Kayfes ..... F41B 5/1469 124/35.2
2,909,167 A * 10/1959 Fredrickson ..... F41B 5/14 124/24.1
3,418,718 A * 12/1968 Current ..... F41G 1/467 124/23.1
3,524,440 A * 8/1970 Hill ..... F41G 1/40 124/24.1
3,667,444 A * 6/1972 Depatie ..... F41G 1/467 124/24.1
4,178,693 A * 12/1979 Smith ..... F41G 1/473 33/265
4,894,921 A * 1/1990 Barlow ..... F41G 1/467 33/265
5,090,805 A * 2/1992 Stawarz ..... F41G 1/467 124/87
5,253,423 A * 10/1993 Sullivan, Jr. ..... F41G 1/467 124/87
5,419,050 A * 5/1995 Moore ..... F41G 1/35 124/87
6,134,793 A * 10/2000 Sauers ..... G01B 11/27 124/87
7,325,319 B2 * 2/2008 Smith ..... F42B 6/04 124/87
2013/0000622 A1 * 1/2013 McCauley ..... F41G 1/467 124/88

* cited by examiner

*Primary Examiner* — Christopher Fulton

(57) ABSTRACT

An offset viewing tube for daylight hours and a laser for lowlight aiming conditions are connected to a bowstring release enabling an archer to aim from behind an arrow nock along the arrow shaft similar to aiming a rifle thus eliminating parallax aiming distortion. The bow can be rotated without moving the aiming device or changing the rear elevation setting. Single pin aiming reduces confusion during setup and rushed shooting. Day or night cameras can be attached.

12 Claims, 4 Drawing Sheets

4
57
50
3
2
5
B
56
51
54
6
A
50
9
10

11
C
57
24
(−)
(+)
D
56
6
51
8
16
A
54
1
12

ARROW AIMING APPARATUS FOR BOWSTRING RELEASES

TECHNICAL FIELD

Archery

This patent claims exclusive rights to an arrow aiming invention and all embodiments intended to perform the functions and claims described herein. It relates in particular to arrow sighting devices for target shooting and hunting with compound or long bows.

BACKGROUND ART

The first recorded arrow shooting and aiming methods were found in ancient cave art where the images depict shooters with long bows held by an extended arm with the string drawn to their chest. This was apparently the conventional draw position for centuries up to and including Native Americans. Aiming from this position is natural in that it maximizes the use of the strong muscles of the arm, chest and shoulder. However, this position presents a significant challenge to aiming an arrow. Shooting from the chest creates a significant angle between the shooter's Line of Sight (LOS) with the target and the desired trajectory of the arrow from the bow. Determining the proper arrow pointing position for the trajectory to intersect the shooter's Line of Sight (LOS) at the desired point on the face of the target is complex with highly variable results. Shooting from this position places the axis of the arrow so far below the shooter's Line of Sight (LOS) that the shooter must rely heavily on instinctive aiming. This non-parallel aiming often described as parallax is counter intuitive and presents a negative impact on target acquisition, position repeatability and overall accuracy.

As early as the 5th century BC the crossbow was introduced as a less instinctive and more accurate method of aiming directly along the shaft of the arrow. This greatly improved the shooter's accuracy. The simple and intuitive nature of aiming directly along the shaft of the arrow meant that a novice with short and simple training could shoot a crossbow with accuracy comparable to a longbow in the hands of an extensively trained and well-practiced shooter. However, even with less accuracy the long bow remained as a weapon of choice for its reloading speed.

As the bow and arrow evolved from a weapon to use in a competitive sport where accuracy was more important than aiming speed the longbow shooters raised the draw point of the arrow nock up from the chest area to the jaw level making it much closer to the eye. Even though it took longer to position and aim with this new anchor point for the arrow string intersection and the draw hand it significantly reduced the parallax angle between the shooter's Line of Sight (LOS) and the axis of the arrow. Positioning the string and arrow intersection to a specific point on or near the shooter's face also made it more repeatable. The aiming errors were reduced improving shooting accuracy and reducing the training time required to become a skilled marksman.

The bow and arrow is no longer considered a significant weapon of war. Today it is recognized as a sport for the art of precision shooting of a bow and arrow at a target. However, the related sport of bow hunting continues to increase in popularity. As such, the demand for archery and bow hunting equipment has also increased. The archery industry has made significant technological advances for bow, arrow and aiming devices in response to this demand.

This patent presents an Arrow Aiming Apparatus for Bowstring Releases that enables the next technological evolution to eliminate parallax by lowering the shooter's eye to aim directly along the shaft of the arrow in a manner that mimics aiming a rifle and provides more flexibility for rotating and tilting the bow while retaining the precision aim.

The following references disclose related sighting systems and are incorporated by reference herein:

U.S. Pat. No. 2,819,707 to Kayfes et al Jan. 14, 1958 for Bow String Drawing and Releasing Device, U.S. Pat. No. 3,418,718 to Current et al Dec. 31, 1968 for Bow and Arrow Sight, U.S. Pat. No. 3,859,733 to Cesnick Jan. 14, 1975 for Archery Peep Sight, U.S. Pat. No. 3,266,149 to Powell Aug. 16, 1966 for Bow Scope Mount, U.S. Pat. No. 7,325,319 B2 to Smith Feb. 5, 2008 for Arrow Mounted Sight, U.S. Pat. No. 8,490,611 B2 Sep. 7, 2010 to Maynard for Distance Compensation Sight Device for Aiming an Archery Bow, U.S. Pat. No. 6,134,793 to Sauers Oct. 14, 2000 for Bow Sight Alignment System, U.S. Pat. No. 7,231,721,B2 to Minica et al. Jan. 19, 2007 Archery Laser Arrow, U.S. Pat. No. 5,419,050 to Moore Sep. 30, 1995 Range Adjustable Laser Sight for Bows.

The bowstring release is a good example of these improvements to the archery aiming process as presented in U.S. Pat. No. 2,819,707. The bowstring release was introduced as an improved method to draw, hold and release the bowstring. The bowstring release eliminated the draw and hold stress created on the fingers by the strings of more powerful bows. It also provided a more repeatable way to secure and anchor the arrow nock for aiming and a smoother release of the string. The symmetrical grasp and release meant less lateral movement of the bowstring compared to sliding off the fingertips and therefore more accurate aiming. A variety of similar but related configurations have evolved into common use by archers.

Many sighting systems include a peep sight connected into the bowstring of an archery bow and at least one sight pin corresponding to a specific target distance U.S. Pat. No. 3,859,733. To aim, the archer normally looks through the peep sight at full draw and aligns the appropriate sight pin with the target. Pin sighting systems require the archer to know or estimate the distance to the target. Thus the accuracy of a shot made by a skilled archer is dependent on the ability to estimate distance to the target. If the distance to the target is known, a problem may still arise when the sight pin system does not have a pin preset for the current shooting distance. In this situation, the archer must shoot between the two pins closest to the current shooting distance thus sacrificing or losing additional accuracy.

The most common bow sights in use today incorporate peep sights into the bowstring and multiple forward pin sights mounted on the bow above the arrow rest. With this setup the shooter's Line of Sight (LOS) and the axis of the arrow still create a significant parallax angle depending on the pin distance above the arrow. Determining the proper correction and compensation for setting the location of the pins may be complex since it involves two independent variables, one for parallax and one for gravity compensation. The shooter's Line of Sight (LOS) and the axis of the arrow only cross at one point. Each pin represents a specific shooting distance from the target therefore the sight pin location, the shooters Line of Sight (LOS), and the trajectory of the arrow must cross exactly at the face of the target. In addition to being set to match a specific shooting distance the elevations of the multiple pins must be adjusted or preset to compensate for arrow fall or drop due to gravity over the horizontal distance traveled. In order for the arrow to successfully strike the desired spot on the target the arrow must be aligned to follow an arched path above the straight line as extended from the centerline axis of the arrow to the target. To determine the proper compensation for drop, multiple arrows are normally launched and measured as part of the pin setup.

This additional adjustment or compensation for gravity further complicates intuitive aiming and setting of the pins. The vertical location of each pin is normally established and preset during trial shooting or setup exercises. The elevation of each pin is positioned and used for arrow aiming at specific shooting distances. Establishing the proper angle and positioning is essentially a trial and error measured deviation process. The proper calibration and pin height are normally established by shooting multiple arrows at one distance from the target until achieving a close group or cluster of arrows in the target. This process is repeated at incremental distances from the target in an effort to simulate normal shooting situations for the shooter and the equipment.

The two primary compensation components of peephole and pin sights are 1) non parallel (parallax) aiming and 2) gravity (arrow drop or fall over extended distance).

1) Non Parallel (Parallax) Aiming

Peephole and pin sights are normally calibrated while shooting with the bow in the vertical position. This places the peephole, pin sight and arrow shaft in a plane that is parallel to the force of gravity. The shooter's Line of Sight (LOS) through the peep hole and around the sight pin aligns with the target. The position of the sighting pin is adjusted to make the shooter's Line of Sight (LOS) intersect the path of the arrow at the face of the target. The shooter's Line of Sight (LOS) and the projection line from the arrow to the target are not parallel therefore; the lines only intersect at one point.

2) Gravity (Arrow Drop or Fall Over Extended Shooting Distances)

Most sighting systems that involve pin sights must be used with the bow in a vertical or near vertical position. Up or downhill shooting complicates the settings for these systems. This invention avoids these complications and restrictions by rotating and tilting the Rear Sight in a manner that retains the height and elevation of the Rear Sight even when the bow is rotated or tilted.

The same peep and pin sights are also used to compensate for the fall of arrows over extended distance shots. The sighting pin is normally lowered an additional amount beyond the parallax adjusted position to raise the arrow path to offset the gravity fall. The pin height is determined by trial and error shooting at incremental distances.

The sighting pins are typically positioned in the plane of the bowstring and arrow thus limiting their use to aiming with the bow in a vertical position or parallel to the force of gravity. Gravity or arrow drop over distance is a key factor in setting the elevation of the sight pins. Therefore, for subsequent shooting of a bow equipped with peep and pin sights or any aiming system that includes non-parallel or parallax aiming, the bow must be held in approximately the same vertical plane that was used during pin setup. It also becomes more difficult for the shooter to see the pins through the peephole sight if the bow is tilted out of the setup plane. Rotating the bow introduces significant aiming errors. As the bow is rotated out of the vertical or setup plane the direction vector for gravity compensation also rotates and rather than elevating the arrow it acts to move the arrow laterally to the bow and out of line with the target. These limit and restrict a hunter's use of peep and pin sights because of the frequent need to position the bow out of the vertical plane to avoid tree limbs, bush and other obstacles. Therefore, when this occurs some hunters attempt to use the lowest pin setting which is normally used for near range shots. This removes drop compensation needed for longer shots. Off axis peep sight aiming is also awkward and limited by the hunter's ability to see through the sights and estimate the distance to the target. Without gravity compensation for longer shots the hunters are left to estimate the distance and drop or just, "aim high", and hope for good luck. The peep and pin aiming process begins with the shooter selecting the appropriate pin based on shooting distance from the target. The shooter then aligns the rear peep sight, the selected pin, and the target. This method of aiming may provide consistent results when properly setup and used by experienced archers. However, for less experienced shooters this non intuitive method of aiming often results in optical confusion and sighting inconsistencies since the shooter's Line of Sight (LOS) is not parallel to the arrow shaft. This visual aberration is often referred to as parallax. As a further complication even experienced hunters sometimes complain that selecting the proper pin during a rushed aiming process can be disruptive and confusing often resulting in poor target acquisition.

U.S. Pat. No. 7,231,721 B2 addresses this issue by proposing to mount a small laser into the arrowhead. This would enable alignment of the arrow direct with the target thus eliminating the parallax. However, this approach would require alteration of each arrow and add weight for the laser and power source to the arrow. Lasers work best in dark or low light conditions. Their use may also be restricted by rules and regional regulations. Viewing a low power laser spot at a distance in full daylight can be difficult at best. Most state of the art bow sights rely on either laser or optical sights for alignment. The lasers provide extremely accurate pointing accuracy along the beam axis. However, conventional mounting of the laser to the bow again results in parallax aiming where the laser beam and the arrow path only cross at one point—U.S. Pat. No. 5,419,050. For longer shots that include drop compensation lasers, like peep and pin sights, must also be aimed in the same position that was used to establish the parallax angle during trial shooting and setup. This restricts hunters from tilting the bow out of the setup position to avoid obstacles. Bow mounted lasers, like pin and peep sights, create a different parallax angle at each distance therefore requiring elevation correction of the sight pin even for close shooting distances that require no gravity compensation. They likewise require trial and error shooting at incremental distances from the target to determine the best laser angle height setting for each distance. Laser sights work best in low light shooting environments. Bright sunshine and/or dark targets absorb the laser light making it extremely difficult if not impossible to see the projected dots.

Optical sights primarily depend on pin alignment sights or scopes. Because they are attached to the bow they too result in opportunities for parallax aiming errors. Both peep and laser sights attach to the bow. This means that the shooter is actually aiming the bow as an indirect means to aim the arrow. Any inconsistencies between the arrow and the bow may contribute to poor target acquisition.

SUMMARY OF THE INVENTION

Technical Problem

Pin sights and peep holes have evolved as the primary means to improve aiming repeatability of the shooter's anchor point and Line of Sight (LOS). Even though these devices improve the shooting repeatability they still include the complexity of parallax vision and may not compensate for arrow fall due to gravity when the bow is tilted out of the normally vertical setup plane.

The ultimate aiming system would improve repeatability, eliminate the confusion created by parallax aiming and enable rotation of the bow while maintaining a means to compensate for arrow fall. This could be achieved if the shooter's eye could be positioned directly behind the nock of the arrow and the rear sight elevation remained constant and vertical even during rotation or tilt of the bow. This would enable the shooter to sight the target along the arrow shaft in a manner similar to the way rifles and crossbows are aimed. However, human physiological limits make it extremely awkward or even impossible to fully draw a long or compound bow in a manner that would allow sighting directly along the shaft of the arrow with the bow in the vertical, rotated, or tilted position.

Need/Problem

To establish a methodology and device that enables an archer to aim an arrow as though they are sighting along the shaft of the arrow similar to the way a marksman aims along the barrel of a rifle. It is physically possible but highly awkward to draw a bow with the shooter's eye positioned directly behind the arrow nock. Attempts normally result in discomfort and muscle strain, foreshortened draw length and significant facial interference if using an arrow release.

Solution to Problem

The word "may" as it appears herein is used in a permissive sense (i.e., having the potential to, being able to). It is not a mandatory requirement (i.e., must). The word "include", or derivations thereof, mean "including, but not limited to". The term "coupled" means directly or indirectly.

This patent comprehends multiple embodiments that enable a plurality of aiming devices to be mounted onto or integrated into a Bowstring Release system wherein an archer may precisely aim along an arrow in a manner similar to aiming a rifle while in conventional vertical, tilted or rotated bow shooting positions. The patent more specifically includes an Aiming Apparatus for Bowstring Releases that may be used in conjunction with forward and rear sighting devices, wherein these sights may be positioned near the forward and rear of the arrow shaft. These forward and rear sights may be so configured that they enable light rays to pass through or around the two sights where the visible rays may be then returned to the eye of the shooter. The sights and the aiming device may be configured in a manner that enables them to be rotated about, or to be positioned around the centerline of the arrow to provide uniform or consistent aiming elevation from the arrow centerline as the bow is rotated from vertical to horizontal. The rotation and tilt maneuvers while not normally used for target shooting are essential for hunting.

The primary objective of the embodiments described herein along with the implied embodiments of this invention enable an archer to view and precisely aim along the entire shaft of an arrow from the nock forward to the target in full daylight or low light environments. Viewing or aiming from this position eliminates the parallax distortion by providing a means for the shooter to see the light rays passing along the shaft of the arrow and reflected from the target. Unlike current state of the art aiming devices or systems that involve parallax the Aiming Apparatus for Bowstring Releases provides the shooter with a straight Line of Sight (LOS) or projection along the axis of the arrow resulting in a natural and instinctive view of the sights in line with the target. Furthermore, this is achieved with minimal physical compromise while shooting from the conventional vertical, tilted or rotated "draw to the jaw" position.

Note: Part numbers in parentheses ( ) correspond to numbers illustrated in the included drawings. Numbers below 50 may be considered as included in the patent. Part numbers 50 and above are used to identify the location of conventional archery equipment relative to components of this patent.

Other improvements and novel details in the construction and arrangement of the various parts and embodiments of the apparatus will be presented in greater detail in the accompanying description which for a clear understanding of the embodiments of the invention should be considered in connection with the drawings forming a part hereof, and wherein are disclosed for the purpose of illustration and may serve as a convenient and satisfactory embodiment of the invention. It is to be noted that material and shape changes in the construction and arrangement may be made without departing from the principle of operation of the various parts and are included as part of this patent.

BRIEF DESCRIPTION OF DRAWINGS

The embodiments of this invention include multiple modifications and alternative forms. The accompanying drawings illustrate some of these embodiments and, together with the description, serve to explain the principles of the invention. The drawings and related descriptions, which are incorporated in and form a part of the specification, are presented as representations of the concept and principles of the invention. They are not intended to limit the embodiments of the invention to the particular form disclosed. The intention is to cover modifications, equivalents and alternatives related to the spirit and scope of the present invention as defined by the appended claims. Representative embodiments of the invention are illustrated as examples in the accompanying drawings.

DETAILED DESCRIPTION OF THE DRAWINGS

Figure 1:
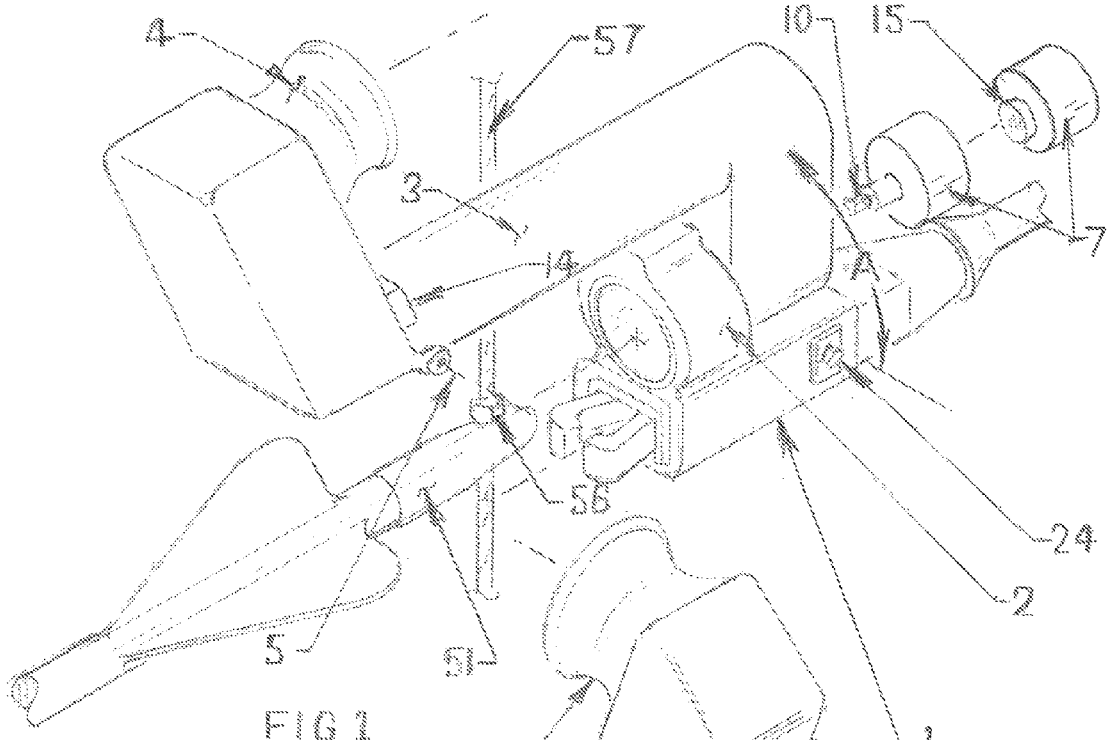

The drawings depict an Aiming Apparatus for Bowstring Releases configured for use with a right hand bow. The configuration for a left hand bow can be assumed to be a mirrored opposite.

Referring now, more particularly to the accompanying drawings, there is provided a Bowstring Release (50) indicated in the entirety by the numerical (50), being of a conventional or custom type and including generally a body which is mounted into an Aiming Device to Bowstring Release Interface (1) which may be designed to accept and fasten to the body of the Bow Release (50). This also includes designs wherein the Bow Release (50) and the Aiming Device to Bowstring Release Interface (1) are integrated or blended into a unitized structure.

DESCRIPTION OF EMBODIMENTS

The embodiments of this invention may include a plurality of aiming devices that may be mounted onto or integrated into a Bowstring Release in a manner that enables an archer to aim along the shaft of an arrow to align the forward and rear ends of the arrow similar to aiming along the barrel of a rifle. The embodiments may enable the archer to precisely align the arrow with the target while in conventional vertical, tilted, or rotated bow shooting positions during daylight or lowlight ambient conditions. Examples of a variety of embodiments that may fulfill the functions of an Arrow Aiming Apparatus for Bow Releases are illustrated in the multiple views of the drawings and described in the Brief Description of the Drawing below.

BRIEF DESCRIPTION OF THE VIEWS OF THE DRAWINGS

Each view is identified by a [Figure—number] wherein the views illustrate examples of typical embodiments of the daylight/lowlight aiming devices and the forward and rear sighting devices that make up the Arrow Aiming Apparatus for Bowstring Releases.

List of Figures and Associated Drawing Page Numbers:

FIG. 1—drawing page 1 is a left side sketch illustrating one method of attaching a daylight viewing scope to a commercial Bowstring Release (50). Note that the Bowstring Release (50) is passing through the Aiming Device to Bowstring Release Interface (1) to grasp the bowstring Bow string Release (50) below the Nock Positioning Bead (56)

Figure 2:
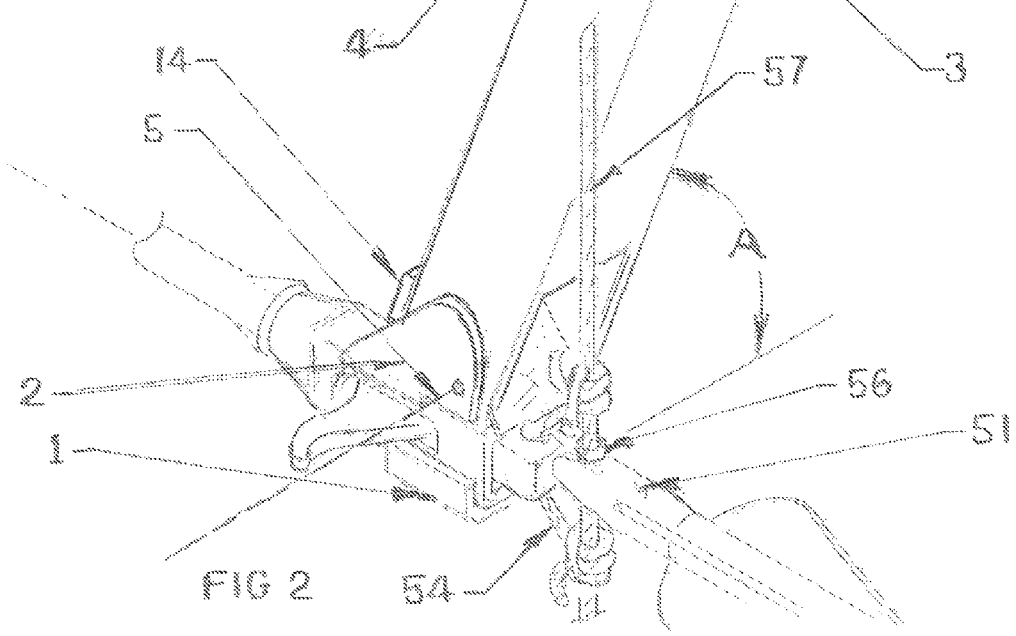

FIG. 2—drawing page 1 is a right side view of another daylight scope embodiment illustrating one means to grasp the bowstring via a string loop.

Figures 3, 4:
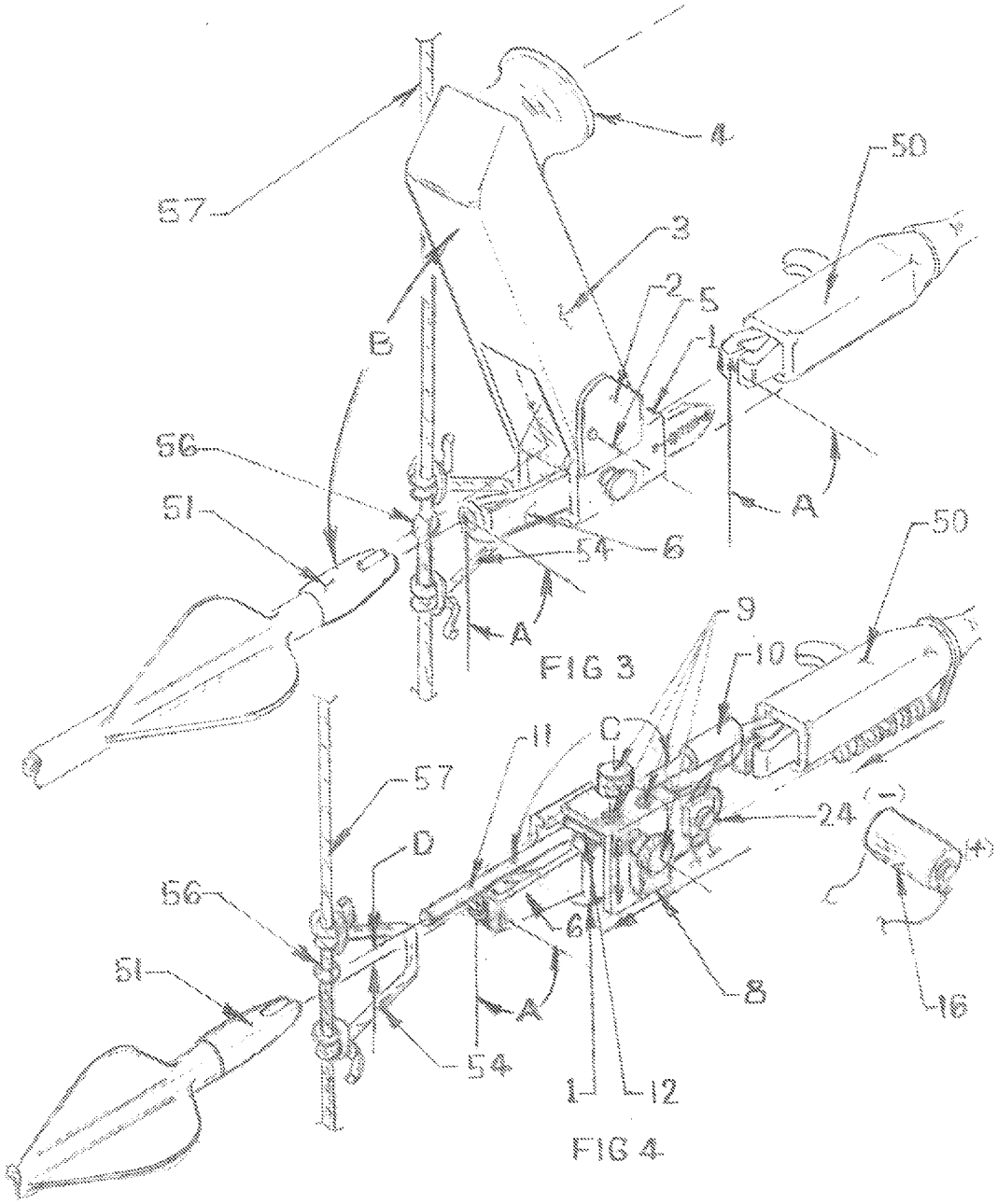

FIG. 3—drawing page 2 is a left side exploded sketch of a daylight scope illustrating the relative position and movement of rotating components.

FIG. 4—drawing page 2 is a left side sketch of one embodiment of the lowlight laser alignment mechanism.

Figures 5, 6, 7:
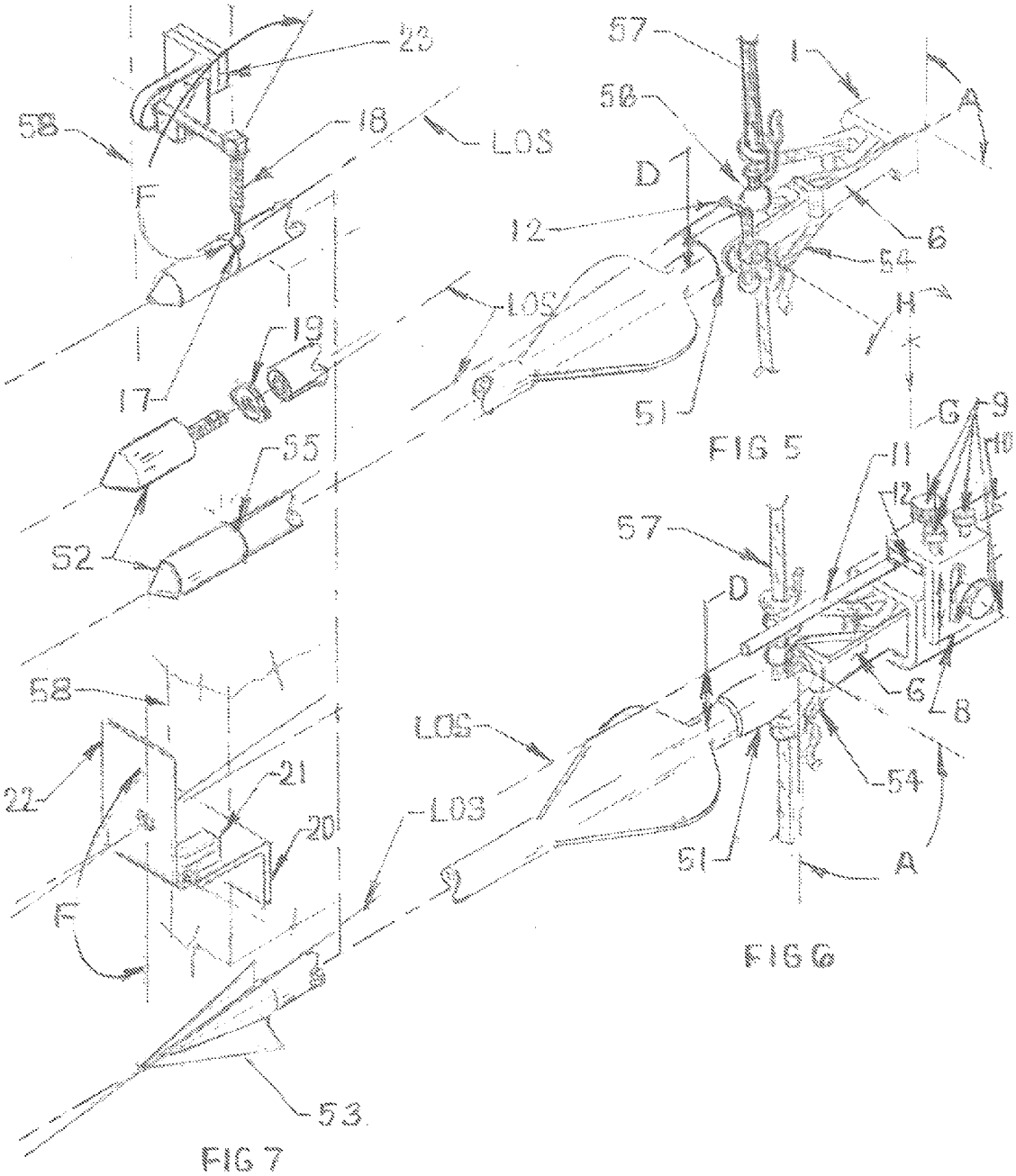

FIG. 5—drawing page 3 is a left side illustration of one embodiment of a rear sight.

FIG. 6—drawing page 3 is a left side illustration of one embodiment of a lowlight laser alignment device.

FIG. 7—drawing page 3 is a left side illustration of forward sighting with arrow heads and examples of alternate aiming accessories.

Figure 8:
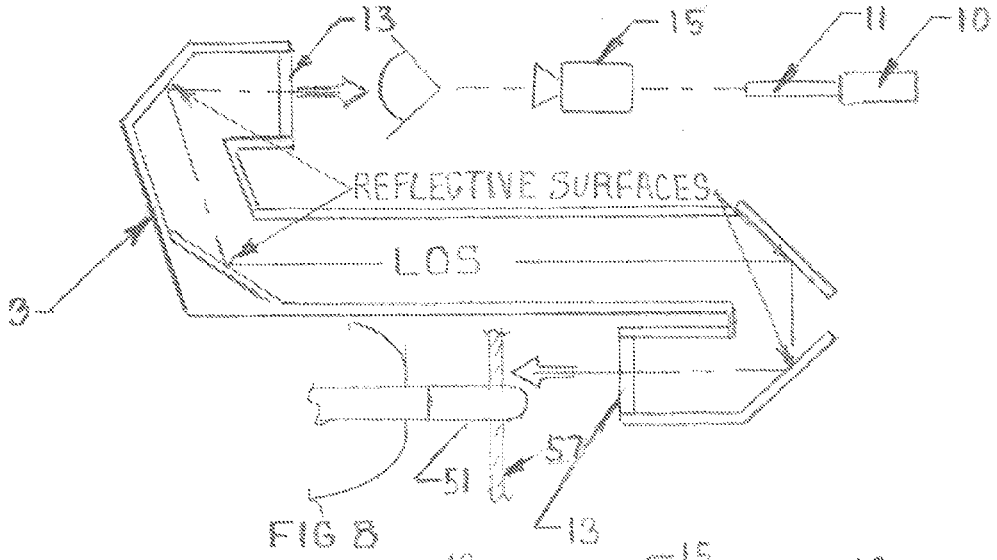

FIG. 8—drawing page 4 is a schematic cross section of one embodiment of a daylight optical viewing tube with double paired reflective services.

Figure 9:
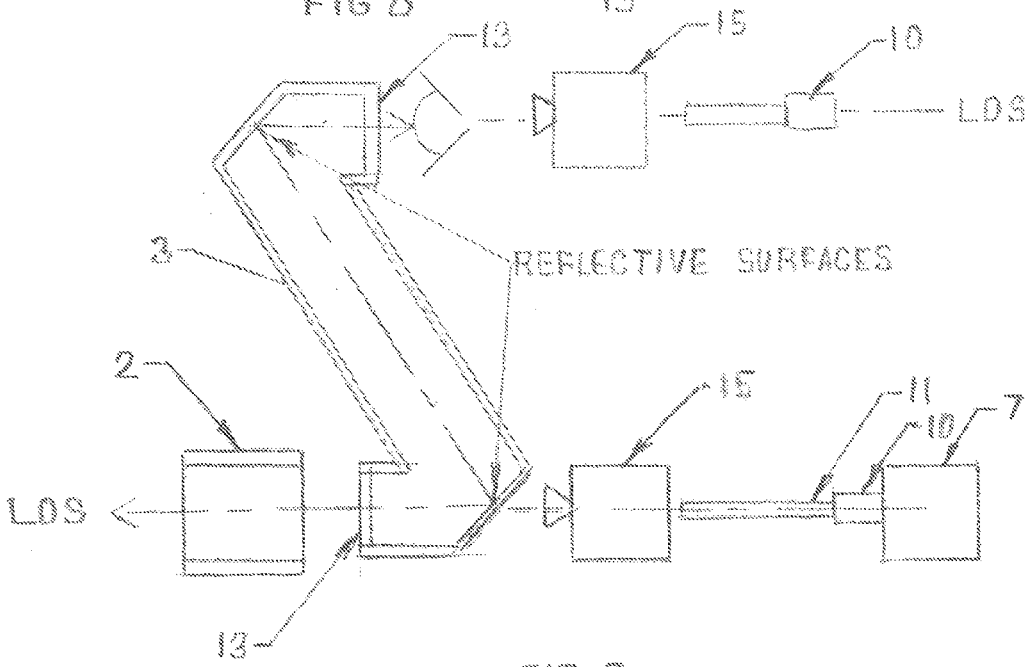

FIG. 9—drawing page 4 is a schematic cross section of one embodiment of a daylight optical viewing tube with a single pair of reflective services.

The embodiments of this invention may embrace a plurality of optical, electrical and electro-optical devices to accurately view the target. These devices may be configured in a manner that enables light rays to pass though or around the Forward and Rear Sights wherein the rays may be returned to the shooter's aiming eye in a manner that guides the shooter for precise alignment of the arrow with the intended target. The key enabling provision of this patent is the connection or integration of aiming and viewing devices onto or into a Bowstring Release which in turn may be attached either directly or via a string loop to the bowstring in a manner that transfers a true and accurate aim of an arrow when shooting a long or compound bow during day or night hours while in the conventional aiming position and/or with the bow rotated for improved hunting accessibility.

Some of the included optical embodiments perform best in bright daylight while some of the electro optical embodiment components excel in low ambient lighting conditions. This patent may comprehend interchangeable or replaceable components that are optimized for a variety of lighting environments. The optimal daylight or low light aiming device may be attached to a Bowstring Release in a manner that enables light rays to be transferred from behind the arrow nock and bowstring interface to the eye of an archer while in the conventional or rotated "draw to the jaw" position. The subtle difference between this system and conventional aiming systems that normally include "peep" sights attached to the string and multiple aiming pins attached to the bow is that the shooter is actually aiming the arrow by moving the bow opposed to aiming the bow as a means to align the arrow. Aiming along the arrow with an "always vertical" sight enables the bow to be rotated without a change to sight elevation settings or introducing lateral shooting misalignment associated with gravity drop components of sights wherein the aiming may be limited to near vertical alignment.

The embodiments of this invention permit the shooter's head and eye to remain in the normal or comfortable shooting positions for daylight or low light shooting environments with the aiming eye well above the arrow shaft and forward of the bowstring and nock interface as illustrated in FIGS. 8 & 9. The embodiments may differ in appearance if the release is attached directly to the bowstring as shown in FIG. 1 or indirectly attached to the bowstring via a String Loop (54) as shown in FIG. 2. However the functionality remains equivalent in that the sighting and/or aiming devices rotate about the centerline of the arrow to facilitate positioning the bow in a vertical, horizontal or in-between position.

The shooter uses a daylight aiming device (examples shown in FIG. 1, 2, 3) to see the light rays as reflected from the target, passed by or through the forward and rear sights, and through the aiming device as if the shooter's aiming eye was positioned immediately behind the arrow nock but with the actual position of the archer's head in conventional shooting positions. The shooter may use a low light aiming device (example shown in FIG. 4) to project collimated light rays from behind the arrow nock through the rear sight Laser Alignment Barrel (11), along the arrow shaft, through or past the forward sight/arrowhead, and onto the target wherein the aiming spot is reflected to the eye of the shooter as a guide to precisely align the arrow to the desired aim point on the target.

As a further improvement the present embodiments of the invention include the provision for devices of the above character wherein improved means are employed for assuring an effective attachment of a plurality of these devices to a Bowstring Release (50) so that the aiming device is properly positioned to enable the shooter to clearly see the sights at the forward and rear ends of the arrow while aligning the arrow with the target without compromising their normal aiming positions.

It is an equally important object of the embodiments of the invention to provide an apparatus configured to the above mentioned character wherein the components that come in contact with the shooter's body may be built from lightweight materials and ergonomically shaped for comfort. The construction of the components is novel and permits the use of pre-existing technologies and devices to further support the viewing and aiming process.

Most particularly the embodiments of the invention embrace the provision of an Arrow Aiming Apparatus for Bowstring Releases that may be comprised of but not limited to: lightweight aiming devices for daylight and/or low light use; an Aiming Device to Bowstring Release Interface (1) that attaches and holds the aiming devices to a Bowstring Release; a Rear Sight located at the rear of the arrow; and a forward sight located at the forward end of the arrow which may be satisfied by the arrowhead or additional Sighting Aids to improve visibility.

Arrow Aiming Apparatus for Bowstring Releases

Component Description

Aiming Device:

Example embodiments of the Aiming Device can be seen in FIGS. 1, 2, 3 & 4. They may be attached to a bowstring release via an Aiming Device to Bowstring Release Interface (1) or integrated directly into the release. The forward end of the Aiming Device may be positioned behind the arrow nock in manner that provides for clear viewing or alignment with the Rear Sight FIG. 5, 6, Forward Sight FIG. 7, and the Target when the bow is rotated to any angle between the normal vertical and the fully horizontal shooting positions.

The subject apparatus of this patent may be fitted with a variety of aiming devices to view and accurately align an arrow with the target. The aiming devices may be configured to rotate around the centerline of the arrow. If the Bowstring Release (50) is used to pull the bowstring via a String Loop (54) as shown in FIG. 2 the rotation occurs naturally about the arrow centerline. However an Aiming Device to Arrow Nock Alignment Probe (6) that interfaces loosely with the tail of the arrow nock similar to the example shown in FIGS. 5 & 6 may be used to maintain a more accurate and immediate alignment of the release and rear sighting devices with the shaft of the arrow. The Aiming Device to Arrow Nock Alignment Probe (6) may be made to advance forward onto the arrow nock as with a spring or other method to provide continuous contact and centering on the arrow as the bow is drawn or rotated.

If the release is used to pull directly on the bowstring (without a string loop) as shown in FIG. 1 the aiming device may be connected via an offset mechanism that compensates and maintains the distance between the arrow centerline and the release centerline during rotation of the bow. The offset mechanism shown in FIG. 1 also acts as an Aiming Device Receiver (2)

All of the embodiments of the aiming devices may be made from lightweight materials and configured to transfer light rays from behind the Arrow Nock (51) and bowstring interface to the eye of an archer while in the normal "draw to the jaw" shooting position.

The light may be transferred along the Line of Sight (LOS) by a plurality of embodiments that may utilize different methodologies with their associated costs. Each embodiment may contain a combination of commercial components and hardware specific to the invention.

One lower cost embodiment of the aiming device uses optical lenses for daylight shooting. The arrangements of these lenses enable the shooter to see the target even on the brightest days with the bowstring drawn to the conventional jaw position. This embodiment may consists of a plurality of paired reflective surfaces, reflection prisms, and magnification lenses wherein these components may be aligned in an Optical Viewing Tube (3) that may be best described as a non-conventional periscope that may consist of a single FIG. 9 or multiple inverted pairs of connected facing periscopes FIG. 8 creating a forward offset in the Optical Viewing Tube (3) to enable the eyepiece and the shooter's eye to be forward of the objective or proximal end of the Optical Viewing Tube (3). The aiming device may transfer the light rays to produce an erect image as viewed from behind the Arrow Nock (51) to the archer's eye. This embodiment may enable the shooter to look into the Protective Eyepiece (4) at the distal end of the aiming device with the Bowstring (57) and Arrow Nock (51) intersection drawn to a point well behind the normal viewing plane of the eye as can be seen in FIGS. 8 & 9. The device may enable the shooter to see an accurate and erect image of the target as it would appear to the naked eye if viewed from behind the Arrow Nock (51) of the arrow. It may also enable the shooter to clearly see the Forward FIG. 7 and Rear Sights FIG. 6, the target, and immediate surroundings of the target. The lengths and bend angles of the Optical Viewing Tube (3) may be altered as long as the angle of the reflective surfaces are positioned to conform to the formula: The angle of incidence of light equals the angle of reflectance. See FIGS. 8 & 9.

The embodiments of the optical aiming device may include a soft Protective Eyepiece (4) for shading the optical lenses and user impact safety. The lenses provide indirect pass through of unaltered light or they may be shaped and tinted for vision correction and comfort. Pairs of double convex lenses may be added to the Optical Viewing Tube (3) as shown in FIGS. 8 & 9 for magnification. The objective and exit pupil ends of the Optical Viewing Tube (3) may be enclosed with clear or tinted glass Viewing or Closeout Lenses (13) to seal and protect the internal Optical Viewing Tube (3) chamber and its contents.

The optical aiming device may include a breakaway joint held with a friction, spring, magnetic, or other minimum force Soft Release Latch (14) and Optical Tube Breakaway Hinge (5) that moves along Axis (B) upon slight impact or other provisions to protect the shooter from accidental "kickback" of the Optical Viewing Tube (3) at arrow release.

The lowlight embodiments of the Aiming Device FIG. 4 are most effective when shooting in near dark environments, therefore, they are primarily used for hunting applications. They may enable hunters to extend their bow hunting day into early morning or late evening hours. They may function by mounting a projection laser near or behind the nock of the arrow in a manner that enables the laser beam to be raised for gravity compensation. They may be integrated directly as a module or feature of the daylight viewing device or operate as an independent device. The connection mechanism may also enable the laser to rotate about the centerline of the arrow while maintaining the offset for gravity compensation.

FIG. 1 illustrates one method utilizing a Support Liner Module (7) with an enclosed Laser (10) and Laser Alignment Barrel (11) that may be inserted into the Aiming Device Receiver (2). The module may enable adjustment for elevation, pan and tilt of the laser beam.

The Laser (10) may be mounted directly behind the arrow shaft and coupled to the Bowstring Release (50). It may be positioned and fitted into the Support Liner Module (7) in a manner that they may move around the centerline of the arrow as the Bowstring Release (50) is rotated. Wherein the Aiming Device Receiver (2) may connect and transfer power to the laser from the Battery Pack (16).

An alternate embodiment for attachment of the Laser (10) and the Laser Alignment Barrel (11) to the Aiming Device and Bowstring Release Interface (1) is shown in FIG. 4. A Panning Plate for Laser Setup (12) may be attached to the Elevation, Tilt, and Pan Support Bracket (8) and used during initial setup to move the Laser from side to side around Axis (E). The Laser Alignment Barrel (11) may be raised and tilted forward and backward around Axis (C) with the two thumbscrews (9) for proper alignment with the centerline of the arrow. The Elevation, Tilt, and Pan Support Bracket (8) may be attached to the Aiming Device to Bow Release Interface (1) in a position that enables the laser beam to be raised, lowered and locked to set the Rear Sight Elevation (D). The Laser (10) and the Laser Alignment Barrel (11) naturally rotate about the centerline of the arrow via the string loop wherein Axis (A) represents the rotation of the Bow to any shooting position from the vertical over to full horizontal. The centering ring of the Aiming Device to Arrow Nock Alignment Probe (6) may be made to slide forward onto the rear of the Arrow Nock (51). Spring pressure or similar methods may be employed to apply and maintain a constant connection between the probe and the rear of the arrow until the arrow releases. This temporary connection between the probe and the arrow nock stabilizes and maintains the Rear Sight Elevation (D) between the Laser Alignment Barrel (11) and the arrow shaft during rotation of the bow. The power supply lines from the Laser (10) may be connected to the on/off Laser and Video Power Switch (24) that may connect with the Battery Pack (16) power source. When powered "on" the Laser (10) may project a beam through the Laser Alignment Barrel (11). The shooter may aim the laser beam by moving the Bowstring Release (50) to align the Laser (10) and Laser Alignment Barrel (11) with one of the forward Sighting methods shown in FIG. 7

Larger lasers may be attached by adding a small periscope similar to the Optical Viewing Tube (3) into the light path to raise the laser and provide clearance for the release and the shooter's hand as shown in FIG. 9. If a larger laser is used the laser may be connected to the first end of the small periscope wherein the second end may be fitted into the Aiming Device Receiver (2). The Laser (10) provides precise alignment along the Axis (A) of the arrow and through or past the Forward Sight FIG. 7. The beam follows the same Line of Sight (LOS) that the shooter uses with the daylight aiming device. The lighted spot on the target represents the intersection of a straight line projected from along the side of the arrow shaft. The spot is reflected from the target to the eye of the shooter. The lighted spot may be seen while in the normal shooting position and is used interactively by the shooter to aim the arrow. The low light aiming devices may enable the shooter to see the laser spot on the target at times when the ambient light is not adequate for the daylight aiming devices.

Ancillary optical, electronic, or electro-optical components may be introduced into the Line of Sight (LOS) as illustrated in FIGS. 8 & 9 to enhance daylight and low light aiming of long and compound bows. One optical embodiment of the aiming device may be an electronic viewing apparatus which may be best described as a Micro High Resolution Camera (15) that may be coupled to a commercial wearable video monitor (not shown). The Camera Mount may be directly or indirectly attached to the release. While the lens based optical viewing devices may be built more rugged and at a lower cost, the electronic viewing devices may be more compact and lighter weight. They may also include viewing improvements essentially consisting of lenses to narrow the field of view and, internal or external zoom or telescopic lenses to magnify and clarify the focus of the image. Night vision may be included to provide a clear view of the arrow shaft, sights and target for low light or night shooting. An alternate embodiment of the camera enables use of a Larger Miniature Camera similar to those commonly found in inspection devices, security systems and spy equipment. The larger camera may be mounted to a modified Optical Viewing Tube (3) FIG. 9. This modification may include a miniature periscope as described above for mounting larger lasers. A small camera may be located immediately behind the Arrow Nock (51) thus eliminating the need for the periscope similar to FIG. 9. The Micro High Resolution Camera (15) may be mounted into a Support Liner Module (7) that fits into the Aiming Device Receiver (2) or coupled directly to the Bowstring Release (50).

The power supply and video out lines run from the camera and may be interfaced with connectors into the Aiming Device Receiver (2). The connector may be linked by wire, fiber optic, wirelessly or other high speed data method to a wearable monitor. The commercial monitor may take any form that works functionally and ergonomically for an archer.

For example, video glasses or a small commercial wearable video monitor may be placed in an easily visible location for the shooter to view the target and sights. An image processor may also be included to modify the image or provide graphic enhancements. The enhancements may include images to accentuate or replace the rear sight, automate the elevation setting, automate the image erection and elevation setting when the bow is rotated, or other special effects. The monitor may be worn on the forearm, head, or mounted on the bow or any visible location. The head devices are frequently attached to eyeglasses. If the monitor is mounted to eyeglasses it may be positioned only over the normal shooting eye. The other lens may be clear, corrective or absent. The connection between the camera and monitor may take the form of any of the conventional methods including but not limited to hardwired, wireless, or fiber optics similar to the "snakes" used in inspection devices. The wearable video monitor may be equipped with sun compatible screens and shades. It may be worn in clear view on the archer's body, normally on the forearm, head, or mounted to the bow.

Battery Pack: FIG. 4

The Battery Pack (16) provides the DC power at the appropriate voltage for the electronic components of the aiming devices. It may be removable. It may be positioned on the release, the arm of the shooter or any place the wires do not interfere with the operation of the aiming apparatus or the comfort of the shooter. The power may be controlled by a Laser and Video Power Switch (24) that may be attached to the Bowstring Release (50), the Aiming Device to Bowstring Release Interface (1) or any placement that fits the functionality and ergonomic operation of the Laser and Video Power Switch (24).

Aiming Device to Bowstring Release Interface (1): FIGS. 1-6

The Aiming Device to Bowstring Release Interface (1) enables embodiments of the aiming device to be coupled to a variety of commercial Bowstring Releases (50) in a manner that positions the objective viewing or projection lenses behind, around and near to the intersection of the Arrow Nock (51) and Bowstring (57). The Aiming Device to Bowstring Release Interface (1) may connect the Viewing Device to the Bowstring Release (50). It may be designed to loosely interface or be permanently coupled to either or both the Bowstring Release (50) and the viewing devices. It may become an integral linkage or be blended into the structure of either or both.

The Aiming Device to Bowstring Release Interface (1) may be constructed in a manner that the proximal side may be attached to an individual or family of releases. The Aiming Device to Bowstring Release Interface (1) may be connected to and used with or integrated directly into commercially available or a custom built Bowstring Release (50). The proximal end of the Aiming Device to Bowstring Release Interface (1) may be permanently connected or integrated as part of a custom built Bowstring Release (50) structure. The distal end may include a generic or custom interface for the attachment of the daylight or low light aiming devices.

The Aiming Device to Bowstring Release Interface (1) also may support the power link from the Battery Pack (16) and a pass through video link between the wearable monitor and electronic aiming device. It may receive power from the Battery Pack (16). It may include a "normally closed" switch of the type including but not limited to a "push button momentary" or "instant on delayed off" Laser and Video Power Switch (24) that opens the circuit for temporary power to pass from the battery to the powered aiming devices. The Laser and Video Power Switch (24) may be positioned at any accessible point between the Battery Pack (16) and the Aiming Device.

The Aiming Device to Bowstring Release Interface (1) may enable the aiming devices to rotate about the arrow Axis (A) up to 90 degrees. This feature enables rotation of the bow to any angle between the normal vertical position and horizontal thus providing more flexibility for a hunter to aim around or between obstacles.

When the Bowstring Release (50) is attached directly to the bowstring (without a String Loop (54)) as shown in FIG. 1, the Bowstring Release (50) is free to swing in left and right direction around the Bowstring (57). When the bow is in the full draw position the natural draw forces tend to pull the Bowstring Release (50) into the plane of the string and the arrow. At the same time the resulting forces may create a pinching action from the nock and string on the jaws of the Bowstring Release (50) causing a slight downward tilt around the Axis (B). To compensate for this the Interface Aiming Device Receiver (2) may include a tilt setting.

Rear Sight

The Daylight Rear Sight may be any visible repeatable position feature located on or near the rear of the arrow shaft or nock. It provides the archer a means to align the arrow with the target. The Rear Sight may be integrated with the arrow, coupled to the Bowstring (57), String Loop (54) or the Bowstring Release (50) or operated as a separate aiming device positioned behind the Arrow Nock (51). It also may serve as a device for adjusting the launch alignment of the arrow to compensate for arrow fall due to gravity over longer shooting distances. The Rear Sight functions similar to that of a rifle rear sight and may take the form of essentially any rifle sight (halo, bead, "v" notch, crosshairs etc.). The Arrow Aiming Apparatus for Bowstring Releases, like the rear sights of rifles, may provide adjustments for arrow fall over time to the target.

Newer technology bows and arrows have increased arrow speed thus decreasing the arrow fall and the number of hunting situations that require gravity compensation. The Rear Sight FIGS. 5 & 6 may be configured to increase the Rear Sight Elevation (D) to compensate for arrow fall. The proper height setting of the Rear Sight may be determined by trial shooting at set distances from the target. For longer shooting distances where arrow drop is a factor the Rear Sight may be adjusted upward to compensate for arrow drop between the bow and the target. This adjustment lifts the Line of Sight (LOS) to be slightly out of parallel with the arrow. The amount of Rear Sight Elevation (D) required to position the Rear Sight for drop compensation may be measured with a plurality of measuring devices.

The Rear Sight may be used to measure the Rear Sight Elevation (D) corresponding to arrow drop during the shooting trials. This may be accomplished by shooting a cluster of arrows from a specific distance using one of the aiming devices with the Rear Sight Elevation (D) set at zero elevation. The average center is marked with an arrow or other marker. The other arrows are removed. To determine the compensation setting the shooter sights down a nocked but undrawn arrow then aligns the Forward Sight, the Rear Sight, which is set at zero elevation (D), and the bullseye. With the arrow still pointed at the bullseye of the target the Rear Sight Elevation (D) is raised to align the Rear Sight and Forward Sight with the arrow still in the target. Addition trial shots are fired to confirm elevation setting accuracy. Once satisfied with repeatability the Rear Sight Elevation (D) is measured in the level plane between the point of launch and the point of landing. The values may be recorded for future shots from the same distance. Note: As previously discussed this Elevation (D) setting will remain constant for any bow rotation or uphill/downhill shots fired at this same distance as measured in a level plane.

If ambient lighting provides laser visibility the measurements may be obtained by using a laser pointer attached to an arrow with the beam tangent to the shaft and aligned with Line of Sight (LOS). This concept is similar to the bow sight alignment system presented in U.S. Pat. No. 6,134,793 but the laser is located on the circumference rather than the centerline of the arrow and is only used for setup and not intended to be drawn or to travel with the arrow. To determine the Rear Sight elevation compensation the shooter aims an undrawn arrow as described above. The laser is used to align and maintain the arrow alignment with the bullseye. The Rear Sight FIGS. 5 & 6 may then be raised and aligned with the marked average of the trial shots. The Rear Sight Elevation (D) is recorded as described above.

Hunting often requires non-vertical shooting positions for the bow, string or arrow to avoid tree limbs, brush and other obstacles. In compliance with the basic laws of Physics the projectile (Arrow) fall over distance is directly related to the time of flight. The amount of fall (Drop) is measured straight down (toward the center of the earth). Therefore, the Rear Sights of this patent may be "always vertical" and unique in that regardless of rotation or tilt of the bow the elevation compensation (D) may remain vertical or parallel to the Path of Gravity (G). This may enable the same Rear Sight compensation values to be used regardless of lateral rotation or up/down tilt of the Bow.

FIG. 5 illustrates one configuration in which the Rear Sight may remain "always vertical". The Rear Sight may be adjusted for the proper Rear Sight Elevation (D). The centering Ring of the Aiming Device to Arrow Nock Alignment Probe (6) may rotate on the tail of the Arrow Nock (51) thus constraining the Rear Sight to rotate concentric about the centerline of the arrow Axis (A).

The Rear Sight may act as a weighted pendulum that rotates about Axis (H). The combination of the rotation about the centerline of the arrow Axis (A) and the tilt about Axis (B) enables the sight to remain vertical or parallel to the Path of Gravity (G) even when the Bow is rotated and the arrow is tilted for uphill or downhill shooting. This means that the Rear Sight Elevation (D) can be set to shoot at the horizontal or level distance to the target in the normal or off normal position and the setting will not need to be changed when the bow is rotated or tilted for uphill and downhill shooting.

This feature maximizes the positioning versatility and ease of bow operation. The bow can be rotated to any position from vertical over to full horizontal while shooting uphill, downhill or on level ground and still maintain the same elevation for the aiming devices and Rear Sight as established during the initial shooting trials. This feature may be especially valuable for shooting in hunting environments.

Rear Sight Lowlight Device: FIG. 6

The Laser Alignment Barrel (11) of the low light Aiming Device may serve as a shield for the laser beam and a key component of the low light Rear Sight. The Laser Elevation, Pan and Tilt Support Bracket (8) supports and aligns the Laser Alignment Barrel (11) and Laser (10). The support bracket works with the centering ring of the Aiming Device to Arrow Nock Alignment Probe (6) to set and maintain the Rear Sight Elevation (D). The support Bracket may provide adjustment for Rear Sight Elevation (D) and Rear Sight Tilt around Axis (C). The centering device of the Aiming Device to Arrow Nock Alignment Probe (6) may connect loosely to the tail of the arrow nock similar to the example shown in FIG. 6. It may be used to more accurately align the release with the centerline of the arrow and control the Elevation (D) as the Laser Alignment Barrel (11) rotates around the centerline of the arrow Axis (A). This in turn provides a baseline for adjustment of the Laser Elevation, Pan and Tilt Support Bracket (8). The Laser Elevation, Pan and Tilt Support Bracket (8) may be used to adjust and control the Rear Sight Elevation (D) of the Laser (10) and the Laser Alignment Barrel (11). The Laser Elevation, Pan and Tilt Support Bracket (8) may also provide mechanisms to adjust and control the Laser Beam Tilt around Axis (C) to point at the Forward Sight as shown in FIG. 4.

Forward Sight: FIG. 7

The function of the Forward Sight FIG. 7 may be satisfied by existing features of a conventional Target Arrowhead (52) or Hunting "Broad" Arrowhead (53). Any small repeatable feature visible from the rear of the arrow can be used as a natural forward sight. For example the root of a Hunting "Broad" Arrowhead (53) blade provides a natural and repeatable position for alignment with the rear sight and target. Likewise a Target Arrowhead (52), a tiny dot of reflective paint or tape, a visible ridge, or any Reflective Arrowhead Feature or Paint (55) can become a natural forward sight.

If a commercial target or hunting arrowhead doesn't provide the needed visibility, Sighting Aids, while not always required, may be positioned near or directly on the arrowhead to enhance visibility and repeatability. Parts (17, 19 & 22) are examples of Sighting Aids.

The Forward Sight Bead (17) is small single bead sight that may be attached to the daylight Forward Sight Flexible Arm (18). The Daylight Forward Sight Mounting Bracket (23) may be attached to the Bow (58) with foam tape, adhesive or mechanical connectors. The Daylight Forward Sight Mounting Bracket (23) may include a rotation stop and support a cantilevered support shaft with a tab that limits the counter clockwise rotation of the Forward Sight Bead (17) tangent to the arrow. The daylight Forward Sight Flexible Arm (18) may be connected by spring, rubber or other lightweight flexible material. The Forward Sight Bead (17) may be configured similar to essentially any rifle forward sight shape and may be attached to the distal end of the daylight Forward Sight Flexible Arm (18). The Daylight Sight Linkage may be free to swing around Axis (F). The sight may be positioned near the forward end and tangent to the arrow for alignment of the Aiming Device, Rear Sight and Target. The Forward Sight Bead (17) at the distal end of linkage may rest on the arrow such that the drag friction will cause the bead and linkage to swing clear with the slightest forward movement of the arrow. The counterclockwise sight rotation may be limited by a Stop to prevent the Forward Sight Bead (17) from passing the tangent point on the arrow during the draw.

An alternate embodiment to improve the visibility of the arrowhead may involve mounting a small single sight bead on the threaded shaft between the arrowhead and arrow shaft. The attachment method may be best described as a small Arrow Forward Sight Ring (19) with an inside diameter that will fit over the threaded shaft of the arrowhead and an outside diameter equal or less than the diameter of the arrow shaft. The small sight bead and a similar non sighting bead on the opposing side of the arrow for balance of weight and drag may be joined as a unit to the periphery of the ring such that they protrude equal amounts outside the shaft to make only the bead or halo visible to the shooter. The beads may be very small—only large enough to be seen from the rear of the arrow. The shapes may be aerodynamically contoured to reduce drag or essentially any small profile desired. The visible sight bead is positioned circumferentially around the arrow shaft to be in line with the Rear Sight and parallel to the axis of the arrow.

This aiming method is similar, except for the attachment, function and sight configuration, to that presented in U.S. Pat. No. 7,352,319 B2 wherein a stack of four sighting beads are attached to the arrow with each bead representing a change in elevation for the forward end of the arrow. The said patent provided an alternative to aiming with multiple pin sights mounted to the bow for arrow drop compensation.

Conversely this configuration of the forward sight embodiment of the Aiming Apparatus for Bowstring Releases may consist of a very small and lightweight single bead on opposing sides of the arrow to balance and minimize the air drag. The function is also different wherein it provides a small single bead for the forward sight with adjustments for arrow drop being controlled by the Rear Sight similar to the rear sight of a rifle.

Forward Sight Lowlight: FIG. 7

The Forward Lowlight Sight Shield (22) as shown in FIG. 7 may be made from opaque plastic, metal or other lightweight sheet material to form a light shield. The shield may be hinge connected to the Forward Lowlight Sight Support Bracket (20) to form a reflecting plane crossing the axis of the arrow. The shield may contain a sighting hole or halo sight on the arrow centerline or tangent to the arrow shaft. The hole may be slightly larger than the laser beam. The shield may be free to swing around Axis F. The rotation may be limited and held lightly in position by a Forward Lowlight Sight Rotation Stop (21). The Forward Lowlight Sight Rotation Stop (21) may function similar to the daylight sight in that it stops and gently holds the rotation in the aiming position. When in place the opaque shield may act as a reflector for the laser beam except at the small pass through halo sight hole. The shield may prevent the light from passing to the target until the rear sight Laser and Alignment Barrel (10 & 11) are perfectly aligned with the forward sight hole. The shield and halo may serve a dual purpose. The bow mounted shield incorporated into the forward sight is extremely valuable to limit the visibility of the laser beam when hunting at night. It provides accurate alignment of the laser beam, shooter's Line of Sight (LOS), and the target.

The laser image provides real time visual feedback to the shooter for quick positioning of the laser beam precisely into the pass through sight hole.

The Forward Lowlight Sight Shield (22) may provide the shooter with visual feedback to guide the Bowstring Release (50) movements to quickly align the beam to pass through the forward halo sight. This confirms that the laser Line of Sight (LOS) is parallel with the axis of the arrow shaft if shooting without elevating the Rear Sight Laser Alignment Barrel (11) for Path of Gravity (G drop compensation. When the Laser (10) is properly aligned tangent to the arrow the spurious light expelled from the outer periphery of the beam may display a streaming line along the arrow shaft.

The shooter may use the laser image (dot, cross, etc) on the target to position the arrow axis precisely on the desired target. The shooter double checks to confirm that the forward sight halo is still illuminated indicating perfect alignment between the Laser (10), the Forward Lowlight Sight Shield (22) and the desired aim point on the target.

The foregoing descriptions of the functional and structural elements of this invention have been presented for purposes of illustration and description and are not intended to be exhaustive or to limit the invention to the precise form disclosed, and obviously many modifications and variations that satisfy the intent and functionality of this invention have not been described herein but are considered part of this invention.

PART NAME WITH (REFERENCE NUMBER)

Aiming Device to Bowstring Release Interface (1)
Aiming Device Receiver (2)
Optical Viewing Tube (3)
Protective Eyepiece (4)
Optical Tube Breakaway Hinge (5)
Aiming Device to Arrow Nock Alignment Probe (6)
Support Liner Module (7)
Laser Elevation, Pan and Tilt Support Bracket (8)
Laser Elevation and Tilt and Thumbscrew (9)
Laser (10)
Laser Alignment Barrel (11)
Panning Plate for Laser Setup (12)
Viewing or Closeout Lenses (13)
Soft Release Latch (14)
Micro High Resolution Camera (15)
Battery Pack (16)
Forward Sight Bead (17)
Forward Sight Flexible Arm (18)
Arrow Forward Sight Ring (19)
Forward Lowlight Sight Support Bracket (20)
Forward Lowlight Sight Rotation Stop (21)
Forward Lowlight Sight Shield (22)
Daylight Forward Sight Mounting Bracket (23)
Laser and Video Power Switch (24)
Archery Parts that Interface with the Aiming Apparatus for Bowstring Releases
Bowstring Release (50)
Arrow Nock (51)
Target Arrowhead (52)
Hunting "Broad" Arrowhead (53)
String Loop (54)
Reflective Arrowhead Feature or Paint (55
Nock Positioning Bead (56)
Bowstring (57)
Bow (58)

The embodiments of this invention in which I claim an exclusive property or privilege are defined as follows:

1. An arrow aiming apparatus connected to a bowstring release and used with a string loop enabling aiming from behind the nock and tangent to the arrow shaft in daylight and lowlight with said apparatus comprising:

(a) an aiming device interface attaching aiming devices of this invention to bowstring releases;
(b) a daylight aiming device using said bowstring release and said string loop;
(c) a reflective arrowhead sighting feature enhancing the visibility of the arrowhead;
(d) a lowlight aiming device using said release and said string loop while aiming a light beam;
(e) a lowlight sight shield using a small hole for alignment of the light beam;
(1) the aiming device interface fitting a plurality of said bowstring releases and affixed to one as means to interchange attachment of the daylight and the lowlight aiming device;
(2) the daylight aiming device comprising an optical viewing tube connected to the aiming device interface by an aiming device receiver;
(3) the aiming device receiver providing a means for angle adjustment and fixing of the optical viewing tube;
(4) the optical viewing tube comprising paired reflective surfaces aligning light exiting to the eye to be parallel to light entering from a line of sight established by the target and arrow shaft;
(5) an alignment feature positioned along the line of sight comprising a vertical filament fixed to the optical viewing tube and a height adjustable horizontal filament as means for gauging elevation;
(6) the optical viewing tube and the vertical filament remaining essentially vertical and the height adjustable horizontal filament continuing to appear parallel to a line tangent to the arrow top as the bow and the string loop are rotated;
(7) the reflective arrowhead sighting feature comprising a single slightly visible detail with aerodynamic blended surfaces and an opposing weight and drag feature peripherally positioned tangent to the arrowhead rear shaft;
(8) the lowlight aiming device comprising a laser alignment barrel affixed to a laser elevation pan and tilt support bracket means for holding a collimated light source and shielding the light beam;
(9) the laser elevation pan and tilt support bracket affixed to the aiming device interface as a means to position, align and set rear elevation of the light beam to project along the arrow;
(10) the aiming device interface affixed to an aiming device to arrow nock alignment probe proximal end while the distal end extends to interface with the arrow nock as a means to gauge and control the light beam rear elevation;
(11) the lowlight aiming device remaining essentially vertical as the string loop and the bow are rotated avoiding need to readjust the light beam elevation for off vertical aiming;
(12) the lowlight sight shield comprising flexible opaque material with a small hole positioned tangent to the arrow as means to reflect the light beam except where properly aligned.

2. The arrow aiming apparatus of claim 1 further comprising the optical viewing tube having a length adjustment as a means to ergonomically position the safety eyepiece to shooter's eye with arrow drawn to lower jaw.

3. The arrow aiming apparatus of claim 1 further comprising the optical viewing tube having a forward tilted enclosed tube with the safety eyepiece opening on rear face at distal end and forward face objective opening at proximal end.

4. The arrow aiming apparatus of claim 1 further comprising the aiming device interface having a quick-connect means for interchange and connection of the daylight and the lowlight aiming devices on the distal side.

5. The arrow aiming apparatus of claim 1 further comprising the lowlight sight shield being affixed to the bow riser by a sight support bracket further comprising a hinged joint means for retraction as the arrow is launched.

6. The arrow aiming apparatus of claim 1 further comprising the daylight aiming device wherein a camera is added and affixed into the line of sight as means for transferring images to a video display device in view of the archer.

7. An arrow aiming apparatus connected to a bowstring release without use of a string loop enabling aiming from behind the nock and tangent to the arrow shaft in daylight and lowlight, with said apparatus comprising:

(a) an aiming device interface attaching aiming devices of this invention to bowstring releases;

(b) a daylight aiming device using said bowstring release without said string loop;

(c) a daylight sight mounting bracket providing retractable linkage for an aiming bead;

(d) a lowlight aiming device using said bowstring release and no string loop to aim a light beam;

(e) a lowlight sight shield using a small hole for alignment of the light beam;

(1) the aiming device interface fitting a plurality of bowstring releases and affixed to one as means to interchange attachment of the daylight and the lowlight aiming device;

(2) the daylight aiming device comprising an optical viewing tube connected to an aiming device interface by an aiming device receiver enabling bow rotation when not using a string loop;

(3) the aiming device receiver comprising a receiving hub and rotation axis around the arrow centerline for affixing objective end of optical viewing tube;

(4) the optical viewing tube being configured similar to the letter S shape with straight sections an elongated center section resulting in a forward offset between the objective end and a safety eyepiece;

(5) an always vertical sighting arm comprising an aiming feature at the distal end, a pendulum balance and elevation adjustment, rotatable joined to an aiming device to arrow nock alignment probe at the proximal end;

(6) the optical viewing tube further comprising a plurality of paired reflective surfaces creating a line of sight through the safety eyepiece, the optical viewing tube, past the nock, the always vertical sighting arm, the arrow shaft, and onto the target;

(7) the paired reflective surfaces positioned along the line of sight directing light entering the objective end to be parallel to light exiting to shooter's eye as means to relay true arrow, target, and sighting images;

(8) the line of sight plane and the always vertical sighting arm remaining essentially vertical reducing need to change elevation adjustment as the bow is rotated or tilted for up or downhill shooting;

(9) the daylight sight mounting bracket being affixed to the bow riser and supporting a sight flexible arm comprising the aiming bead at the distal end positioned tangent to the arrow and providing rotary retraction as the arrow is launched;

(10) the lowlight aiming device comprising a cylindrical first support liner module that inserts into the rotation hub of the aiming device receiver as means to affix a collimated light source;

(11) the aiming device to arrow nock alignment probe proximal end being affixed to the aiming device interface and the distal end extending to interface with the arrow rock as a means to align the aiming device to arrow during vertical or rotated aiming;

(12) the light beam and arrow establish a plane that can be rotated around the arrow enabling the plane to remain essentially vertical as the bow is rotated, avoiding need to readjust the light beam elevation;

(13) the lowlight sight shield comprising flexible opaque material with a small hole positioned tangent to the arrow as means to reflect the light beam except where properly aligned.

8. The arrow aiming apparatus of claim 7 further comprising the daylight and the lowlight aiming devices having a quick-connect feature on the proximal end for mating to the aiming device interface.

9. The arrow aiming apparatus of claim 7 further comprising the optical viewing tube having length adjustment as a means to ergonomically position the safety eyepiece to shooter's eye with arrow drawn to lower jaw.

10. The arrow aiming apparatus of claim 7 further comprising the lowlight sight shield further being affixed to the bow riser by a sight support bracket comprising a hinged joint means for retraction as the arrow is launched.

11. The arrow aiming apparatus of claim 7 further comprising the first support liner module having means to adjust position, rear elevation and alignment of the light beam to project along the arrow.

12. The arrow aiming apparatus of claim 7 further comprising the daylight aiming device wherein a second support liner module is added into the line of sight to position and affix a camera for transferring images to a video display device in clear view of the archer.

* * * * *